US009771830B2

(12) United States Patent
Maar et al.

(10) Patent No.: US 9,771,830 B2
(45) Date of Patent: Sep. 26, 2017

(54) HOUSING SECTION OF A TURBINE ENGINE COMPRESSOR STAGE OR TURBINE ENGINE TURBINE STAGE

(71) Applicant: MTU Aero Engines AG, Munich (DE)

(72) Inventors: Karl Maar, Pfaffenhofen an der Ilm (DE); Thomas Hess, Munich (DE); Petra Kufner, Poing (DE)

(73) Assignee: MTU Aero Engines AG, Munich (DE)

( * ) Notice: Subject to any disclaimer, the term of this patent is extended or adjusted under 35 U.S.C. 154(b) by 426 days.

(21) Appl. No.: 14/258,656

(22) Filed: Apr. 22, 2014

(65) Prior Publication Data

US 2014/0321998 A1 Oct. 30, 2014

(30) Foreign Application Priority Data

Apr. 24, 2013 (DE) ..... 10 2013 207 452

(51) Int. Cl.

| | |
|---|---|
| ***F01B 25/16*** | (2006.01) |
| ***F01D 25/28*** | (2006.01) |
| ***F01D 11/12*** | (2006.01) |
| ***F01D 25/14*** | (2006.01) |
| ***F01D 21/04*** | (2006.01) |

(52) U.S. Cl.

CPC ..... *F01D 25/28* (2013.01); *F01D 11/125* (2013.01); *F01D 21/045* (2013.01); *F01D 25/14* (2013.01); *F05D 2250/183* (2013.01); *F05D 2250/711* (2013.01); *F05D 2250/712* (2013.01)

(58) Field of Classification Search

CPC ..... F01D 11/125; F01D 21/045; F01D 25/14; F01D 25/28; F05D 2250/183; F05D 2250/711; F05D 2250/712

See application file for complete search history.

(56) References Cited

U.S. PATENT DOCUMENTS 3,046,648 A * 7/1962 Kelly ..... F16J 15/444 228/181
3,365,172 A * 1/1968 Howald ..... F01D 11/08 277/414
3,719,365 A * 3/1973 Emmerson ..... F01D 11/12 277/414
RE30,600 E * 5/1981 Long ..... B32B 3/12 277/414
4,411,589 A * 10/1983 Joubert ..... F01D 21/045 415/121.2
4,452,335 A * 6/1984 Mathews ..... F02C 7/24 181/214
4,466,772 A * 8/1984 Okapuu ..... F01D 11/08 415/171.1
5,160,248 A * 11/1992 Clarke ..... F01D 21/045 156/276
5,520,508 A * 5/1996 Khalid ..... F01D 11/08 415/119
5,791,871 A * 8/1998 Sech ..... F01D 11/122 415/173.1
5,899,660 A * 5/1999 Dodd ..... F01D 9/041 415/108
6,182,531 B1 2/2001 Gallagher et al.
6,575,694 B1 * 6/2003 Thompson ..... F01D 21/045 415/173.4
7,766,603 B2 * 8/2010 Beckford ..... F01D 21/045 415/119
7,914,251 B2 * 3/2011 Pool ..... F01D 21/045 415/119
8,061,967 B2 * 11/2011 Marlin ..... F01D 21/045 415/9
8,202,041 B2 * 6/2012 Wojtyczka ..... F04D 29/023 415/119
8,231,328 B2 * 7/2012 Reed ..... F01D 21/045 415/174.4
8,371,009 B2 * 2/2013 Xie ..... B29C 73/04 29/402.09
8,500,390 B2 * 8/2013 Wojtyczka ..... F04D 29/526 415/173.4
2007/0297910 A1 * 12/2007 Pool ..... F01D 21/045 416/224
2011/0076132 A1 * 3/2011 Bottome ..... F01D 21/045 415/9
2011/0217156 A1 * 9/2011 McMillan ..... F01D 21/045 415/9
2012/0134774 A1 * 5/2012 Clark ..... B65D 43/0222 415/9
2012/0224958 A1 * 9/2012 Reed ..... F01D 21/045 415/213.1

FOREIGN PATENT DOCUMENTS

| | | |
|---|---|---|
| EP | 2363576 | 9/2011 |
| GB | 2313161 | 11/1997 |

* cited by examiner

*Primary Examiner* — Jesse Bogue

(74) *Attorney, Agent, or Firm* — Davidson, Davidson & Kappel, LLC

(57) ABSTRACT

A housing section of a turbine engine compressor stage or a turbine engine turbine stage that, in particular, has a closed and annular-shaped, radially outer casing. The radially outer casing has radially inwardly extending webs that are angled at a slant relative to the radius.

14 Claims, 2 Drawing Sheets

HOUSING SECTION OF A TURBINE ENGINE COMPRESSOR STAGE OR TURBINE ENGINE TURBINE STAGE

This claims the benefit of German Patent Application DE 10 2013 207 452.2, filed Apr. 24, 2013 and hereby incorporated by reference herein.

The present invention relates to a housing section of a turbine engine compressor stage or a turbine engine turbine stage, as well as to a turbine engine, in particular a gas turbine, having such a housing section.

BACKGROUND

In the case of a turbine engine compressor stage or a turbine engine turbine stage, a housing section surrounds a flow space in which rotating rotor blades are configured. The danger arises during operation of the turbine engine that the rotor blades or a part thereof break(s) and strike(s) the housing section with high kinetic energy. Safety considerations necessitate minimizing deformation of the housing section. To that end, the wall thickness of the housing section can be increased. However, this disadvantageously increases the weight of the housing section.

SUMMARY OF THE INVENTION

It is an object of the present invention to provide a turbine engine compressor stage or a turbine engine turbine stage that will feature adequate safety at a low weight.

In accordance with the present invention, a turbine engine compressor stage or a turbine engine turbine stage has at least one housing section having a radially outer casing. The radially outer casing has a plurality of radially inwardly extending webs; the webs being angled at a slant relative to the radius. In one variant, the radially outer casing has a closed and annular-shaped form, especially in cross section. In a further refinement, the radially outer casing may be longitudinally divided and be permanently or releasably composed of two or more parts. In one variant, the webs are joined in a substance-to-substance bond to the radially outer casing, in particular, integrally formed therewith, in particular, produced from a master mold.

An advantage of radially inwardly extending webs may reside in that the weight of the housing section is not significantly increased, but, at the same time, it is ensured that any striking of rotor blades or of parts thereof does not lead to excessive deformation of the radially outer casing and, thus, of the housing section. In addition or alternatively, an advantage of the housing section may reside in that it may be produced in an additive manufacturing process, it being possible for different materials to be used in the manufacturing of the housing section. In addition or alternatively, an advantage of such webs may reside in that the rigidity of the housing section is positively influenced, thereby facilitating the transmission of maximum loads.

Along the lines of the present invention, a housing section for a turbine engine compressor stage or a turbine engine turbine stage is understood, in particular, to be a housing section that includes one or a plurality of rotor blade stages of a turbine engine that are disposed in succession in the direction of flow. At least one guide vane stage may be located upstream and or at least one guide vane stage may be located downstream of the turbine engine compressor stage and/or turbine engine turbine stage.

In one variant, a turbine engine compressor stage is understood to be that section of the turbine stage which exclusively compresses an air-mass flow intended for a combustion chamber of the turbine engine. In contrast, a fan installed upstream of the turbine engine compressor stage may deliver the air-mass flow and a bypass flow. Alternatively or additionally, in one turbine engine compressor stage, a diameter ratio of the rotor blades to the guide vanes may be greater than or equal to 0.5, in particular 0.75, preferably 0.85.

Along the lines of the present invention, a radius is understood to be a direction from a longitudinal axis of the housing section to the radially outer casing, the direction extending orthogonally to the longitudinal axis.

In contrast to purely radially extending webs, the angling of webs at a slant relative to the radius makes possible a more advantageous deformation characteristic of the webs, respectively of the housing section. In addition or alternatively, webs that are angled at a slant relative to the radius, as clarified in the following, may be used for defining cooling passages.

In one preferred variant, the webs may be axially slanted. This means that the webs may extend along the longitudinal axis of the housing section and orthogonally thereto. In addition or alternatively, the webs may extend in the circumferential direction of the housing section. In one variant, the webs are joined to an inner casing. Radially inwardly from the inner casing, a flow channel casing may be configured that defines a flow space of the stage. In the same way, the inner casing itself may define the flow space of the stage and thus function as a flow channel casing. Additionally or alternatively, the webs may be interconnected. The webs may have a circular or polygonal form in a cross section orthogonally to the web longitudinal axis. In one variant, the webs may each define, respectively surround a hollow space that may be axially slanted analogously to the webs and extend longitudinally.

In one variant, one or a plurality of hollow spaces defined, in particular surrounded by the webs communicate with a coolant inlet, in particular a cooling air inlet and/or a coolant outlet, in particular cooling air outlet. The coolant inlet and/or the coolant outlet may each be provided in a housing shell that may be configured axially upstream, respectively downstream from the housing section of the turbine engine compressor stage or turbine engine turbine stage.

The housing shell may surround at least one guide vane stage. In one variant, a hollow space defined by webs communicates exclusively with the coolant inlet and/or the coolant outlet. In one variant, the hollow space does not communicate with a flow space in which, inter alia, the rotor blades and/or the guide vanes are configured and which is surrounded by the housing section and the housing shells.

The hollow spaces preferably make it possible to reduce a heat input into the housing section and thereby reduce the temperature of the housing section. In one variant, this makes it possible for other materials to be used for manufacturing the housing section that may result in a weight reduction of the housing section. In addition, the hollow space may be used for transferring coolant, in particular cooling air, between the upstream and downstream housing shells, which may likewise have a positive effect on the heat input into the housing section. In cross section, in particular in a cross section orthogonally to the longitudinal web axis, the, in particular interconnected, webs may have a grid or honeycomb structure. This makes it possible to very readily reduce the previously mentioned heat input, and/or to improve the transfer of coolant between the housing shells.

A further advantage of such a hollow space defined by webs may reside in that it allows coolant to be transported between the housing shell located upstream and downstream from the housing section in a manner that is virtually free of leakage losses. In addition or alternatively, the number of components and thus potential wear points may be thereby reduced.

In accordance with one aspect of the present invention, the webs may be prefolded. The webs may be prefolded in a way that induces them to fold in accordance with a predefined folding characteristic in response to a load application, for example, in response to an impact caused by a broken rotor blade or a part thereof. This type of web design makes it possible to ensure that the housing section is low in weight and that it does not deform upon striking of rotor blades or parts thereof against the same. Due to the folding action, the webs attenuate the impact and thereby prevent damage to the housing section.

Individual webs may be separated from one another by a hollow space and/or not joined to one another. It is equally possible that individual webs are joined to an inner casing, in particular by an end that is distal from the radially outer casing.

In one variant, the webs may be prefolded numerous times, in particular in a zigzag shape, convexly and/or concavely. This makes possible an advantageous folding characteristic of the housing section in the event of any striking of the rotor blades or of parts thereof against the housing section. Prefolded webs may, in particular, feature at least two sections that, preferably at one edge, merge integrally with one another and are angled at a slant relative to the radius axially in opposite directions and/or circumferentially.

A stiffening portion may be configured in a hollow space between the webs. In cross section, the stiffening portion may feature a grid or honeycomb structure. In the event of any striking of the rotor blades or of parts thereof against the housing section, the stiffening portion may improve the rigidity of the housing section and counteract a deformation thereof.

The housing section described above may be a component of a turbine engine, in particular a gas turbine. It is clear that the turbine engine may also feature a plurality of the housing sections described above.

BRIEF DESCRIPTION OF THE DRAWINGS

Further features and advantages will become apparent from the dependent claims and the exemplary embodiment. In this regard:

DETAILED DESCRIPTION

Figure 1:
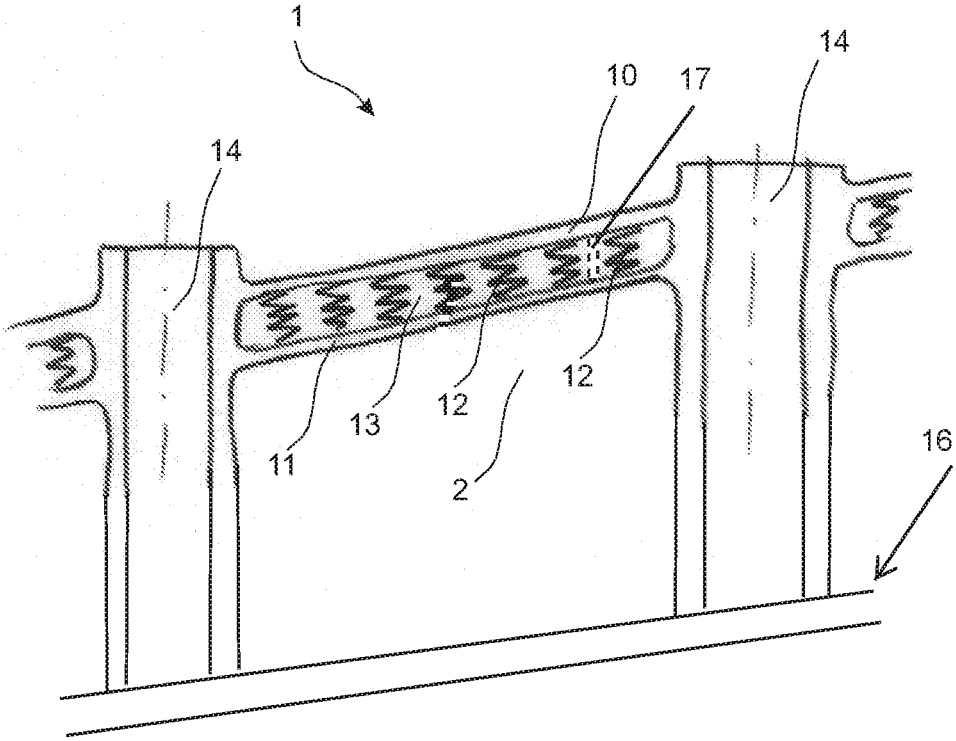
FIG. 1 shows a longitudinal section of a housing section in accordance with one embodiment of the present invention.

In the following, similarly designed components of the particular variants are provided with the same reference numerals and are denoted the same way.

In accordance with a first variant, housing section 1 shown in FIG. 1 has a radially outer casing 10 and an inner casing 11. Radially outer casing 10 is separated from inner casing 11 by a hollow space 13. In hollow space 13, a plurality of webs 12 extend radially inwardly from radially outer casing 10. At one end, webs 12 are joined to radially outer casing 10 and, at the other end, to inner casing 11. A flow channel casing 16, which defines a flow space 2, is configured radially inwardly from inner casing 11. Rotor blades 4 (shown in FIGS. 2 and 4 discussed below) are configured in flow space 2. Also illustrated in dashed lines is an optional stiffening portion 17 of the housing between the webs 12.

In addition, housing section 1 features a plurality of mutually axially offset guides 14 for adjustable guide vanes (not shown in FIG. 1). Guides 14 are each integrally formed with radially outer casing 10 and inner casing 11, and are joined by form-locking, a substance-to-substance bond and/or frictionally to flow channel casing 16.

Webs 12 are prefolded numerous times and thus angled at a slant relative to the radius, so that, in the event housing section 1 is subject to a load application, webs 12 are folded in accordance with a predefined folding characteristic. In particular, a radial folding of webs 12 takes place. Webs 12 are disposed axially mutually adjacently within hollow space 13 and prefolded numerous times in a zigzag shape.

Figure 2:
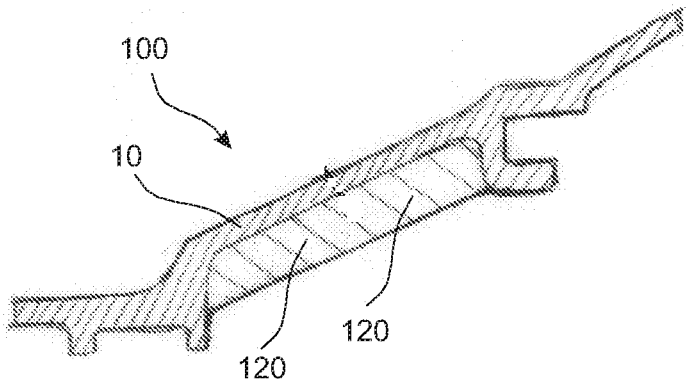
FIG. 2 shows a longitudinal section of a housing section in accordance with a further embodiment of the present invention.

A longitudinal section of a housing section 100 in accordance with a further embodiment of the present invention is shown in FIG. 2. Housing section 100 features a radially outer casing 10 from where a plurality of webs 129 extend radially inwardly, webs 120 being interconnected. Webs 120 are axially slanted; in the illustrated case, webs 120 extending diagonally to a longitudinal axis (not shown) of housing section 100 (horizontally in FIG. 2).

In a cross section orthogonally to the longitudinal web axis, interconnected webs 120 form a grid or honeycomb structure.

Figure 3:
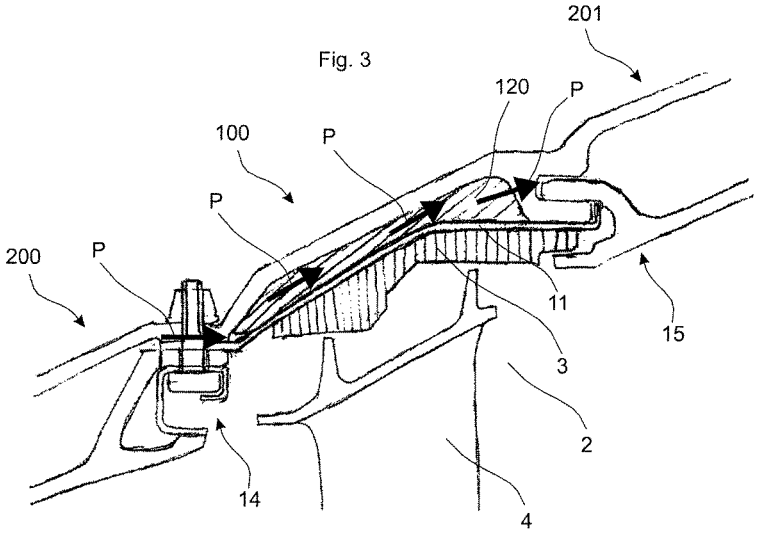
FIG. 3 shows a longitudinal section of a housing section in accordance with a further embodiment of the present invention, including an inner casing and separate abradable means, such as abradable or run-in coating.

In addition to housing section 100 shown in FIG. 2, housing section 100 illustrated in FIG. 3 features an inner casing 11. Webs 120 are joined to radially outer casing 10. Analogously to webs 120 illustrated in FIG. 2, webs 120 shown in FIG. 3 surround hollow spaces, through which cooling air from a cooling air inlet (left in FIG. 3) is directed to a cooling air outlet (right in FIG. 3), as indicated in FIG. 3 by flow arrows.

At the side of inner casing 11 facing away from webs 120, a radially inwardly extending abradable means 3 is provided. Abradable means 3 may come in contact with a rotor blade 4 and is used, in particular, for reducing an undesired leakage flow between rotor blade 4 and inner casing 11 of housing section 100.

At the upstream side thereof (left in FIG. 3), housing section 100 is joined in connecting portion 14 via a screw connection to a housing shell 200. In addition, at the downstream side thereof (right in FIG. 3), housing section 100 is joined via another connecting portion 14 to another housing shell 201. Each of the two housing shells 200, 201 may surround a guide vane stage (not shown). The connection of further housing shell 201 with housing section 100 may be a form-locking connection.

Figure 4:
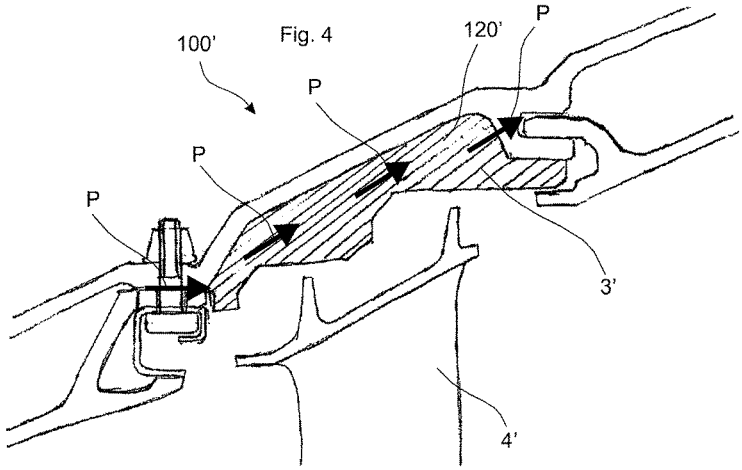
FIG. 4 shows a longitudinal section of a housing section in accordance with a further embodiment of the present invention, without an inner casing and with integrated abradable means.

Housing section 100' illustrated in FIG. 4 differs from housing section 100 shown in FIG. 3 in that no inner casing 10 is provided therein. Abradable means 3' is formed in one piece with webs 120'. It is ensured in this context that the abradable means is positioned in a way that allows it to come in contact with rotor blades 4'.

Webs 120, 120' illustrated in FIG. 2 through 4 are formed and oriented in a way that allows at least one portion of the hollow spaces surrounded in each case by the webs to communicate with a cooling air inlet port and/or a cooling air outlet port. The cooling air inlet port is provided in connecting portion 14, and the cooling air outlet port in further connecting portion 15. The cooling air inlet port and the cooling air outlet port communicate with a cooling air channel provided in respective housing shell 200, 201.

Thus, the formation and orientation of the webs may ensure that cooling air flows via the cooling air inlet port into the hollow spaces of the webs and via the same to the cooling air outlet port. As a result, cooling air is able to flow via housing section 100 between two housing shells 200, 201 that are adjacently disposed in the longitudinal axis direction of the turbine engine, arrows P illustrating the direction of flow of the cooling air in the figures. The webs and the cooling air inlet port and the cooling air outlet port are configured in a way that does not allow the cooling air to communicate with flow space 2 of the turbine engine.

LIST OF REFERENCE NUMERALS

1 housing section in accordance with the first variant
2 flow space
3 abradable means
4 rotor blade
10 radially outer casing
11 inner casing
12 web in accordance with the first variant
13 hollow space
14 connecting portion
15 further connecting portion
16 flow channel casing
100 housing section in accordance with the second variant
100' housing section in accordance with the third variant
120 web in accordance with the second variant
200 housing shell
201 further housing shell
P flow direction of the cooling air

What is claimed is:

1. A housing section of a turbine engine compressor stage or turbine engine turbine stage comprising:

a closed and annular-shaped, radially outer casing;

an inner casing located radially inward of the outer housing casing and separated from the outer housing casing, the inner housing casing located radially outward from a plurality of rotor blades of the turbine engine compressor stage or turbine engine turbine stage;

wherein the outer housing casing has a radius having radially inwardly extending webs, the webs being angled at a slant relative to the radius, each web having a first end and a second end, each web being joined to a surface of the inner housing casing at the first end and joined to a surface of the outer housing casing at the second end.

2. The housing section as recited in claim 1 wherein the webs are axially or circumferentially angled at a slant relative to the radius; wherein the webs define at least one hollow space and wherein the at least one of the hollow spaces defined by the webs communicate with a coolant inlet or coolant outlet.

3. The housing section as recited in claim 1 wherein, in a cross section, the webs form a grid or a honeycomb structure.

4. The housing section as recited in claim 1 wherein the webs are prefolded numerous times.

5. The housing section as recited in claim 1, wherein the housing section includes a stiffening structure configured in a hollow space between the webs.

6. A turbine engine comprising at least one housing section as recited in claim 1.

7. A gas turbine comprising the turbine engine as recited in claim 1.

8. The housing section as recited in claim 1, further comprising an abradable coating on a side of the inner housing casing opposite the webs.

9. A housing section of a turbine engine compressor stage or turbine engine turbine stage comprising: a closed and annular-shaped, radially outer casing; an inner casing located radially inward of the outer housing casing and separated from the outer housing casing, the inner housing casing located radially outward from a plurality of rotor blades of the turbine engine compressor stage or turbine engine turbine stage; wherein the outer housing casing has a radius having radially inwardly extending webs, the webs being angled at a slant relative to the radius, each web having a first end and a second end, each web being joined to a surface of the inner housing casing at the first end and joined to a surface of the outer housing casing at the second end; wherein the webs are prefolded in a radial direction.

10. The housing section as recited in claim 7 wherein the webs define at least one hollow space.

11. The housing section as recited in claim 10 wherein the web surround the at least one hollow space.

12. The housing section as recited in claim 10 wherein at least one of the hollow spaces defined by the webs communicates with a coolant inlet or coolant outlet.

13. The housing section as recited in claim 9 wherein the webs are prefolded in a zigzag shape, convexly or concavely.

14. The housing section as recited in claim 13 wherein the stiffening structure has a grid or honeycomb structure in cross section.

* * * * *